US008127468B2

(12) United States Patent
Morgan

(10) Patent No.: US 8,127,468 B2
(45) Date of Patent: Mar. 6, 2012

(54) FOOTWEAR CONSTRUCTION

(75) Inventor: Mark M. Morgan, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 461 days.

(21) Appl. No.: 12/481,669

(22) Filed: Jun. 10, 2009

(65) Prior Publication Data

US 2010/0313450 A1 Dec. 16, 2010

(51) Int. Cl.
*A43B 13/18* (2006.01)
*A43B 13/28* (2006.01)
*A43D 11/00* (2006.01)

(52) U.S. Cl. ..... 36/30 R; 36/17 R; 36/28; 12/142 T

(58) Field of Classification Search ..... 36/30 R, 36/25 R, 28, 31, 17 R, 21, 17 PW; 12/146 B, 12/142 D, 142 T
See application file for complete search history.

(56) References Cited

U.S. PATENT DOCUMENTS

| | | | | |
|---|---|---|---|---|
| 648,209 | A | | 4/1900 | Jackson |
| 712,437 | A | | 10/1902 | Schermerhorn |
| 1,111,437 | A | | 9/1914 | Butterfield |
| D83,027 | S | | 1/1931 | Arnold |
| 1,944,805 | A | | 1/1934 | Osborne |
| 2,034,650 | A | | 3/1936 | Brown |
| 2,071,065 | A | | 2/1937 | Everett et al. |
| 2,079,705 | A | | 5/1937 | Gordon |
| 2,201,382 | A | | 5/1940 | Vizard |
| 2,289,335 | A | | 7/1942 | Ayers |
| 2,359,681 | A | | 10/1944 | Rovick |
| D141,974 | S | | 8/1945 | Wright |
| 2,438,095 | A | | 3/1948 | Phinney |
| 2,753,636 | A | | 7/1956 | Withington, Jr. |
| 2,754,600 | A | | 7/1956 | Vizard |
| 2,922,236 | A | | 1/1960 | Rubico |
| 3,046,679 | A | | 7/1962 | Maertens et al. |
| 3,046,680 | A | | 7/1962 | Hill et al. |
| 3,098,308 | A | | 7/1963 | Liebscher et al. |
| 3,170,253 | A | | 2/1965 | Johnson |
| 3,190,016 | A | | 6/1965 | Hansjosten |
| 3,216,033 | A | | 11/1965 | Nadler |
| 3,308,560 | A | | 3/1967 | Jones |
| 3,416,174 | A | | 12/1968 | Novitske |
| 3,416,244 | A | | 12/1968 | Radcliffe et al. |
| 3,474,496 | A | | 10/1969 | Klee |
| 4,316,335 | A | * | 2/1982 | Giese et al. ..... 36/129 |
| 4,562,606 | A | * | 1/1986 | Folschweiler ..... 12/142 RS |
| 4,651,443 | A | | 3/1987 | Eckstrom |

(Continued)

FOREIGN PATENT DOCUMENTS

| | | |
|---|---|---|
| DE | 473381 | 3/1929 |

(Continued)

*Primary Examiner* — Marie Patterson
(74) *Attorney, Agent, or Firm* — Warner Norcross & Judd LLP

(57) ABSTRACT

A welted footwear construction with a direct-attach outsole and an internal tray containing a low density cushioning material. The welt may be secured to the upper and insole by one line of stitching and to the tray by a second line of stitching. The tray may include separate heel and forefoot cavities, each containing a low density cushioning material. The tray may be manufactured from thermoplastic urethane ("TPU") and may contain low-density polyurethane ("PU"). The low-density PU may be molded in place within the cavities in the tray. The outsole may be directly attached to the undersurface of the tray, and may be manufactured from high-density PU.

20 Claims, 7 Drawing Sheets

U.S. PATENT DOCUMENTS

| | | | | |
|---|---|---|---|---|
| 4,663,865 | A | 5/1987 | Telecemian | |
| 4,685,223 | A | 8/1987 | Long | |
| 5,092,060 | A * | 3/1992 | Frachey et al. | 36/29 |
| 5,493,791 | A * | 2/1996 | Kramer | 36/28 |
| 5,542,195 | A | 8/1996 | Sessa | |
| D377,561 | S | 1/1997 | McClelland | |
| 5,768,801 | A | 6/1998 | Huff | |
| 5,775,005 | A | 7/1998 | McClelland | |
| 5,784,736 | A | 7/1998 | Issler et al. | |
| 5,890,248 | A | 4/1999 | Gee | |
| 5,992,054 | A | 11/1999 | Rauch | |
| 6,038,790 | A * | 3/2000 | Pyle et al. | 36/30 R |
| 6,226,895 | B1 | 5/2001 | McClelland | |
| 6,660,205 | B1 * | 12/2003 | Harkins, Sr. | 264/244 |
| 6,754,982 | B2 | 6/2004 | Reed et al. | |
| 6,802,138 | B2 * | 10/2004 | McManus et al. | 36/28 |
| 7,010,867 | B2 | 3/2006 | Brown | |
| 7,197,840 | B2 | 4/2007 | Nakano | |
| 7,200,955 | B2 * | 4/2007 | Foxen | 36/25 R |
| 7,225,491 | B2 | 6/2007 | Reed et al. | |
| 7,946,060 | B2 * | 5/2011 | Rosenbaum | 36/30 R |
| 2004/0143995 | A1 | 7/2004 | McClelland | |
| 2006/0218819 | A1 * | 10/2006 | Wu | 36/28 |
| 2010/0313450 | A1 * | 12/2010 | Morgan | 36/17 R |

FOREIGN PATENT DOCUMENTS

| | | |
|---|---|---|
| DE | 1012846 | 7/1957 |
| EP | 0018663 | 12/1980 |
| FR | 495987 | 10/1919 |
| GB | 815876 | 7/1959 |
| GB | 2086710 | 5/1982 |
| JP | 62100002 | 6/1987 |
| JP | 2172401 | 7/1990 |
| JP | 9193260 | 8/1997 |
| WO | WO9607536 | 3/1996 |

* cited by examiner

FOOTWEAR CONSTRUCTION

BACKGROUND OF THE INVENTION

The present invention relates to footwear and more particularly to footwear constructions and methods for manufacturing footwear.

There is a wide variety of constructions used by the footwear industry to form footwear. In many cases, the construction used for a specific article of footwear is selected based on the intended use of the footwear. For example, some sole constructions are selected for their durability, others for their flexibility and comfort, while still others are selected for their aesthetic appeal. One particularly popular type of sole construction is referred to as a welt construction. Welt constructions are popular because they are durable and are aesthetically desirable. There is a variety of different types of welt constructions, but in a typical construction a "welt," for example, a strip of material such as leather or hard rubber, is used to intersecure the sole and the upper. The welt extends around the article of footwear at the seam between the upper and the sole, and is secured to both the upper and the sole to indirectly join the two. In a traditional welt construction, the upper is closed by an insole having a downwardly extending rib, and the welt is attached to upper by stitching (or staples) that extends through the upper and the insole rib. This forms an upper/insole assembly that may be attached to the sole. Referring again to a traditional welt construction, a midsole is attached to the upper/insole assembly by stitching (or staples) that extends through the welt and the midsole. Afterwards, an outsole is secured to the bottom of midsole, typically by an adhesive.

To improve the flexibility and reduce the weight of the sole, a variety of welt constructions have been developed which incorporate a polyurethane ("PU") outsole that is direct attached to the undersurface of the midsole. Although available in a broad range of densities, PU is generally a relatively soft material and it is not as wear-resistant as many other outsole materials, such as leather and rubber. To extend its life, a direct-attach outsole is typically manufactured from high density PU. High density PU has improved durability, but suffers from certain disadvantages. For example, high density PU is heavier and stiffer than low density PU. Accordingly, its use can result in footwear that is both stiffer and heavier. As another example, high density PU may have a greater tendency to crack and separate from the midsole under the stress of repeated flexing during use. Experience has shown that this tendency worsens with thicker PU components. Accordingly, manufacturers that wish to use direct attach outsoles are typically faced with a choice of balancing various advantages and disadvantages.

SUMMARY OF THE INVENTION

The present invention provides a welted footwear construction with a direct-attach outsole and an internal tray containing a low density cushioning material. In one embodiment, the tray includes separate heel and forefoot cavities, each containing a low density cushioning material. In one embodiment, the tray is manufactured from thermoplastic urethane ("TPU") and the low density cushioning material is low-density polyurethane ("PU"). The low-density PU may be molded in-situ within the tray. The outsole may be direct attached to the undersurface of the tray, and may be manufactured from a high-density PU.

In one embodiment, the footwear construction includes a welt secured to the upper and to the tray. In this embodiment, the footwear construction may include an insole with a peripheral rib. The welt may be stitched or stapled to the peripheral rib by stitching or staples extending through the upper and the rib. The welt may also be stitched or stapled to the peripheral edge of the tray.

In one embodiment, the peripheral rib defines a cavity beneath the undersurface of the insole. The cavity may be filled with a filler material. In one embodiment, the tray is secured to the undersurface of the filler material. For example, the tray may be cemented to the undersurface of the filler material.

The present invention also provides a method for manufacturing an article of footwear. In one embodiment, the method includes the steps of: (a) combining an upper and an insole; (b) securing a welt to the insole/upper combination; (c) forming a tray with at least one cavity; (d) introducing a low density cushioning material to the cavity; (e) securing the tray to the welt; and (f) direct attaching an outsole to the tray. In one embodiment, the step of forming the tray is further defined as injection molding a tray from TPU. In one embodiment, the step of introducing a low density cushioning material to the cavity is further defined as molding a low-density PU in place within the cavity to form a unitary component.

The present invention provides a footwear construction and method of manufacture that combines durability, low-weight and comfort. The tray permits a portion of the sole to be manufactured from a low density cushioning material that provides enhanced cushioning. In addition, the tray and low density cushioning material occupy space that would otherwise have been filled by the high-density outsole material. Accordingly, the tray reduces the thickness of the high-density outsole material, thereby reducing weight and the chances of cracking and separation.

These and other objects, advantages and features of the invention will be more fully understood and appreciated by reference to the description of the current embodiment and the drawings.

DESCRIPTION OF THE CURRENT EMBODIMENT

Figure 1:
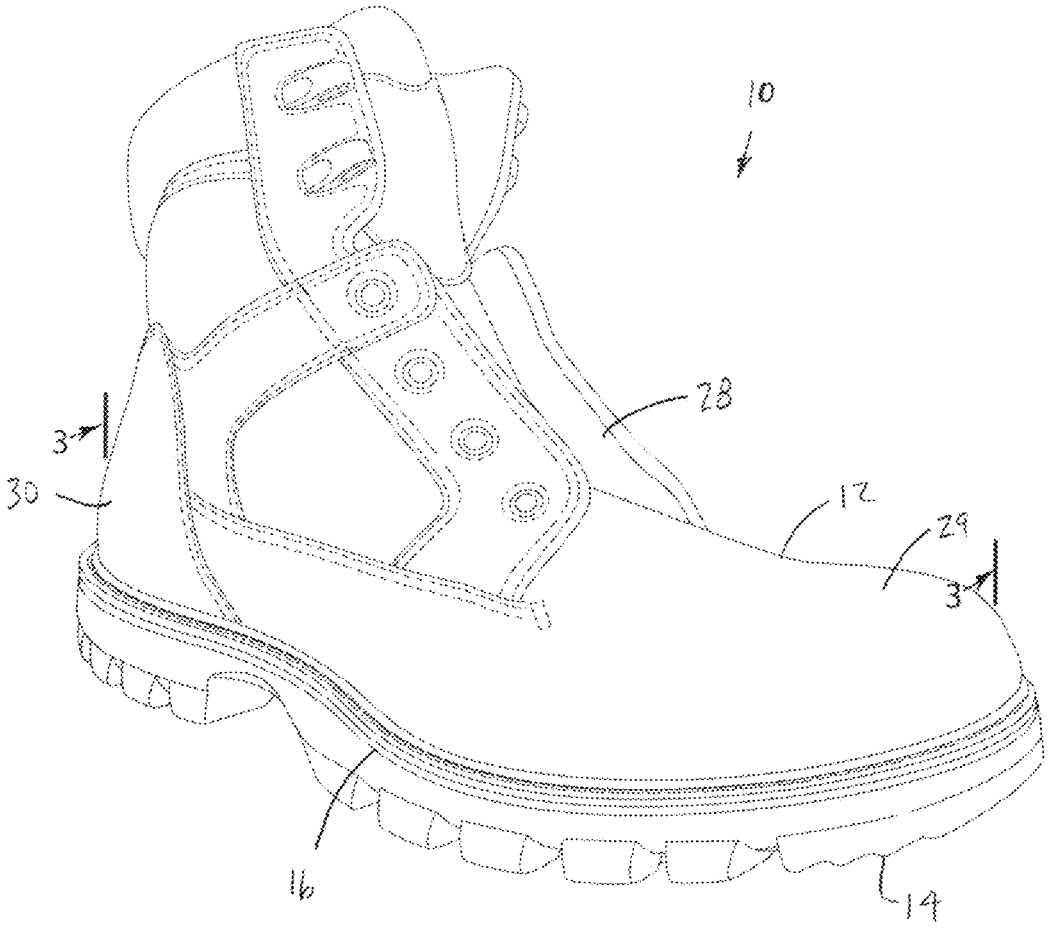
FIG. 1 is a perspective view of an article of footwear in accordance with an embodiment of the present invention.
Figure 2:
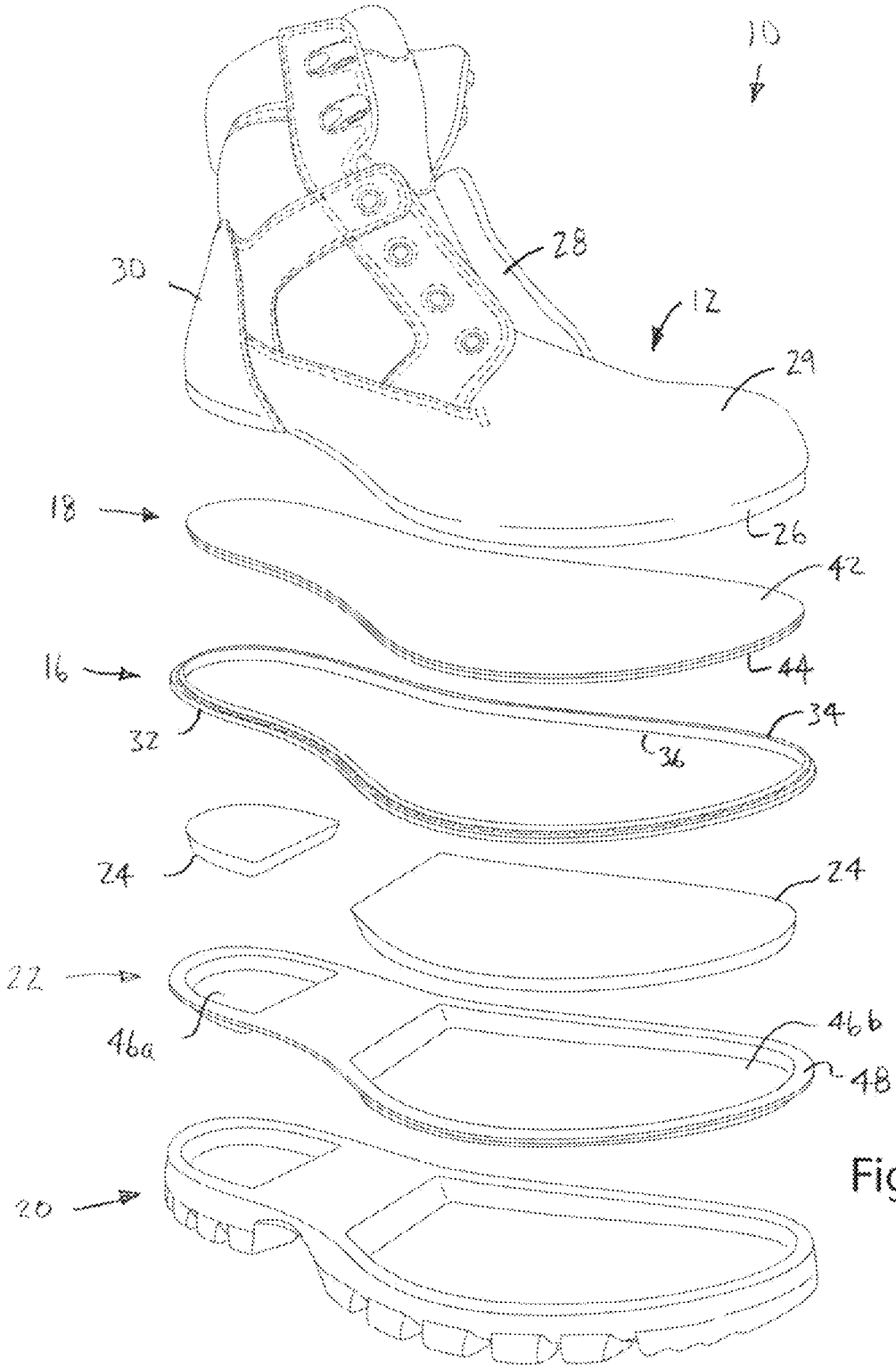
FIG. 2 is an exploded perspective view of the article of footwear.
Figure 3:
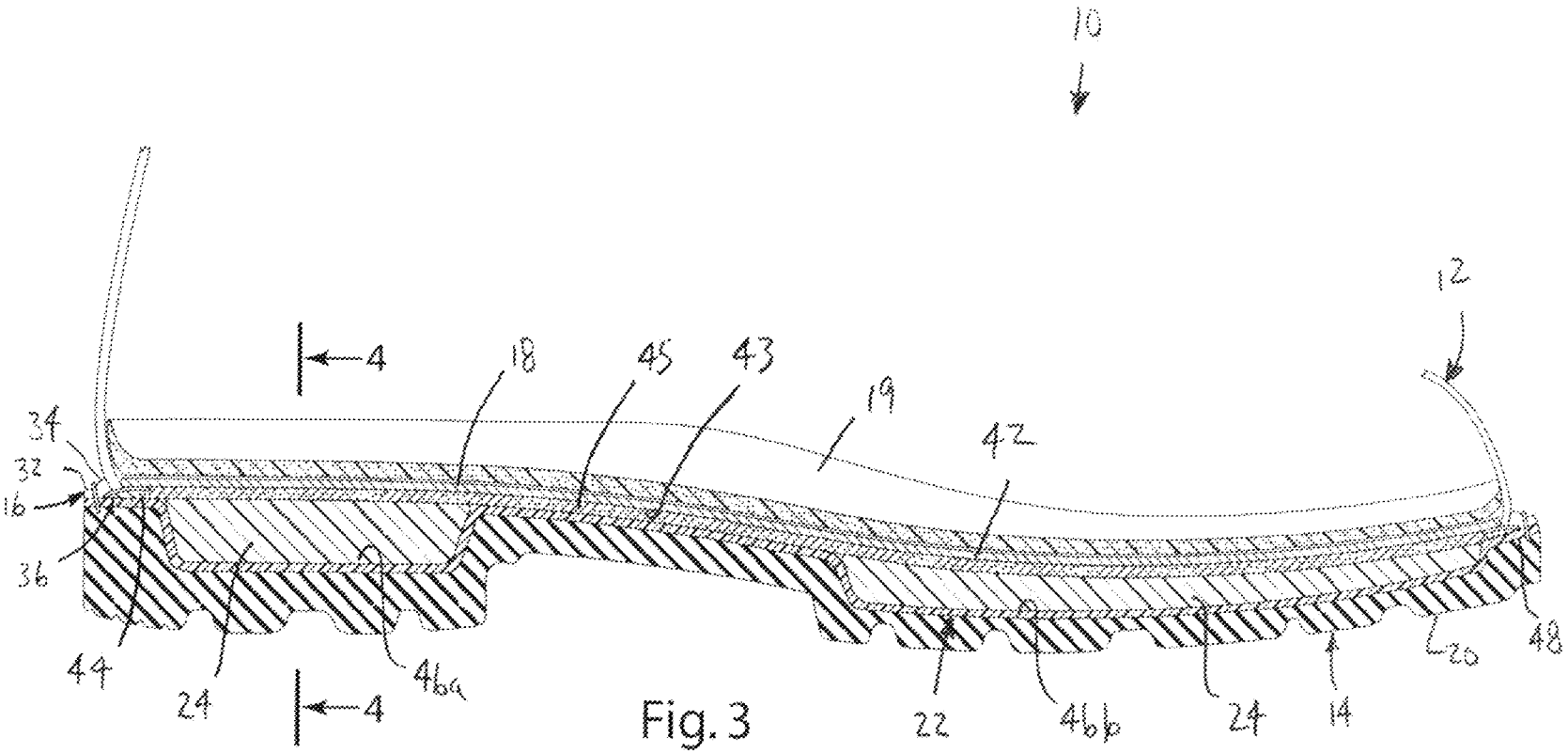
FIG. 3 is a cross-sectional view of the article of footwear taken along line III-III of FIG. 1.

A boot constructed in accordance with a preferred embodiment of the present invention in shown in FIGS. 1 and 2, and generally designated 10. In general, the boot 10 includes an upper 12 that is secured to the sole 14 by a welt 16. As perhaps best shown in FIG. 3, the sole 14 includes an insole 18, a tray 22 and an outsole 20. The tray 22 of this embodiment defines separate heel and forefoot cavities 46*a-b* that contain filling material 24, such as low density polyurethane. The illustrated welt 16 is attached to and interconnects the upper 12, the insole 18 and the tray 22. In this embodiment, the outsole 20 is direct-attached to the undersurface of the tray 22, and is manufactured from high-density polyurethane.

For purposes of disclosure, the present invention is described in connection with a conventional ¾ height boot. The present invention is, however, well suited for use with essentially all other types of soled footwear that can accommodate a welt construction. For purposes of this disclosure, directional terms, such as upper, lower, top, bottom, inner and outer, are used to denote directions with respect to the boot shown in the figures and are not intended to limit the invention to implementation in any specific orientation.

Figure 4:
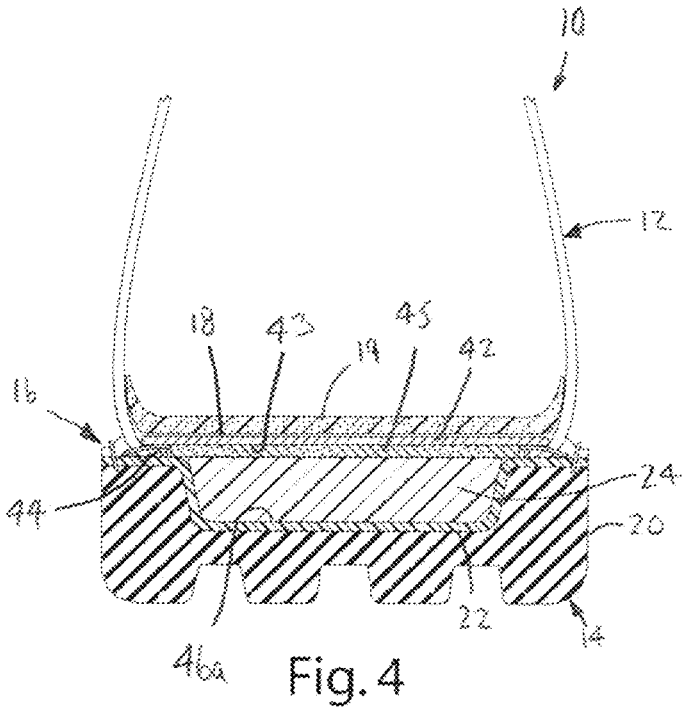
FIG. 4 is a cross-sectional view of the article of footwear taken along line IV-IV of FIG. 1.
Figure 5:
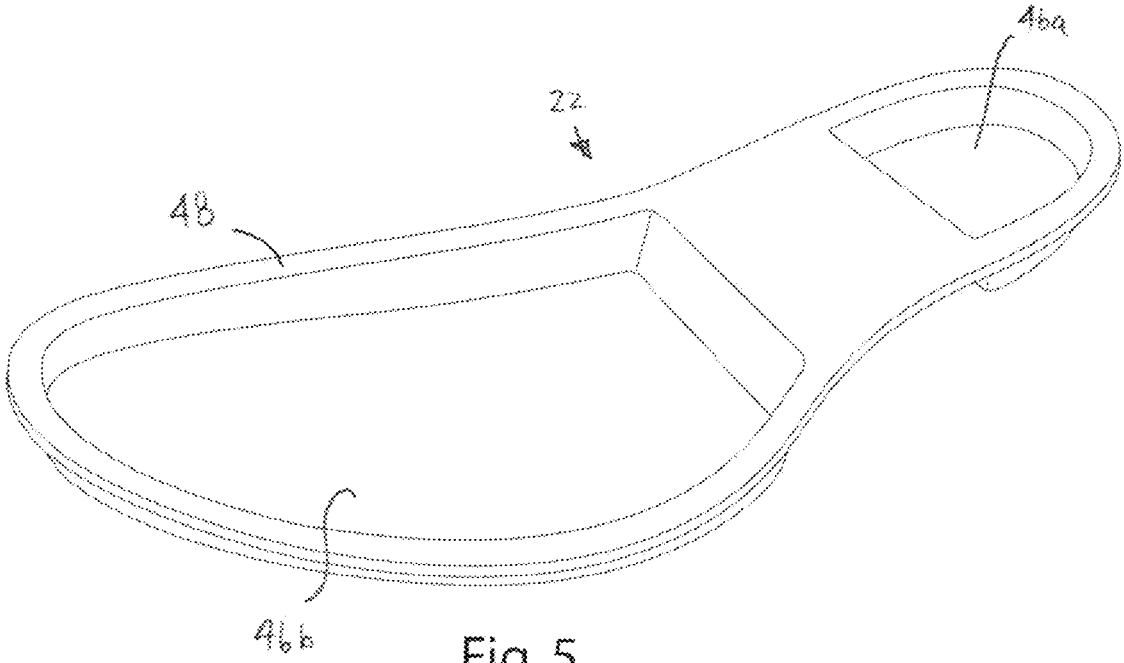
FIG. 5 is a perspective view of the tray.

In the illustrated embodiment, the upper 12 is a generally conventional upper. Accordingly, the upper 12 will not be described in detail. Suffice it to say that the upper 12 generally includes a quarter 29, a vamp 28, and a heel piece 30. The upper 12 terminates in a lower peripheral edge 26 that is attached to the sole 14 as described in detail below. The upper 12 is preferably manufactured from leather, canvas, nylon or other suitable materials, and may include a liner (not shown) or other conventional accessories. If desired, a footbed 19 or other cushioning element may be fitted into the upper above the sole 14 to provide additional cushioning and support (See FIGS. 3 and 4).

The welt 16 extends entirely around the boot 10 to interconnect the upper 12 and the sole 14. As perhaps best shown in FIGS. 1 and 2, the welt 16 is also generally conventional. The welt 16 includes a generally horizontal base portion 32 with an upwardly extending upper rib 34 located toward the center of the base portion 32 and a downwardly extending lower rib 36 located at the inner edge of the base portion 32. The outer surface of the upper rib 34 is rounded to, among other things, reduce the profile of the welt 16. The lower rib 36 is generally rectangular in cross-section and is of sufficient size to receive staples, stitching or other fastening elements. Although not shown, the horizontal base portion may define an upwardly opening stitch groove that extends around the welt 16 near its outer edge. The stitch groove, if included, may be adapted to receive the stitching 40 that interconnects the welt 16 to the tray 22 as described in more detail below.

As noted above, the sole 14 includes an insole 18, a tray 22 and an outsole 20. The tray 22 contains a filling material 24, such as low-density polyurethane. If desired, the sole 14 may also include a shank (not shown) or other conventional sole components. The insole 18 is generally conventional and includes a base 42 and a downwardly extending rib 44. The base 42 is generally planar and corresponds in shape with the outline of a foot. The insole rib 44 extends downwardly from and around the base 42 near its outer edge. The insole rib 44 is of sufficient size to receive staples, stitching or other fastening elements. The bottom surface of the base 42 and the insole rib 44 cooperatively define a void 43. In the illustrated embodiment, the void 43 contains a filler material 45, such as carpet pad.

As noted above, a tray 22 is disposed in the sole 14 between the insole 18 and the outsole 20. The tray 22 of the illustrated embodiment is generally planar with the exception of separate heel and forefoot cavities 46*a-b*. The tray 22 includes a peripheral lip 48 extending around the periphery of the tray 22, which as described below is secured to the welt 16. To facilitate attachment, the peripheral lip 48 is generally coextensive with the welt 16. Although the illustrated peripheral lip 48 is coextensive with the welt 16 in the assembled boot 10, the tray 22 may be manufactured with a peripheral lip 48 that extends outwardly beyond the welt 16. In this case, the peripheral lip 48 may be trimmed flush with welt 16 during manufacture of the boot 10. The tray 22 may be manufactured from a flexible yet durable material. For example, the tray 22 may be manufactured from thermoplastic urethane ("TPU"). The characteristics of the tray 22 may be varied to assist in tuning the characteristics of the sole 14. For example, the thickness and density of the tray material may vary from application to application to vary the flexibility (e.g. lateral and longitudinal stiffness) and cushioning characteristics (e.g. compressibility and resiliency) of the sole 14. The characteristics of the tray 22 may vary from region to region. For example, the thickness of the tray 22 may be increased in the arch region to permit the tray 22 to function as a shank. The heel and forefoot cavities 46*a-b* may be longitudinally spaced to provide the tray with a generally planar shape through the arch region of the boot 10. The heel cavity 46*a* extends through a significant portion of the heel region of the boot 10 providing a region of low-density cushion material below the heel. Similarly, the forefoot cavity 46*b* extends through a significant portion of the forefoot region of the boot 10 providing a region of low-density cushion material below the forefoot. The heel cavity 46*a* and the forefoot cavity 46*b* may have different depths. For example, the heel cavity 46*a* may be deeper than the forefoot cavity 46*b* to provide additional low density cushioning material below the heel, which generally encounters greater impact forces than the forefoot during a stride.

Figure 6:
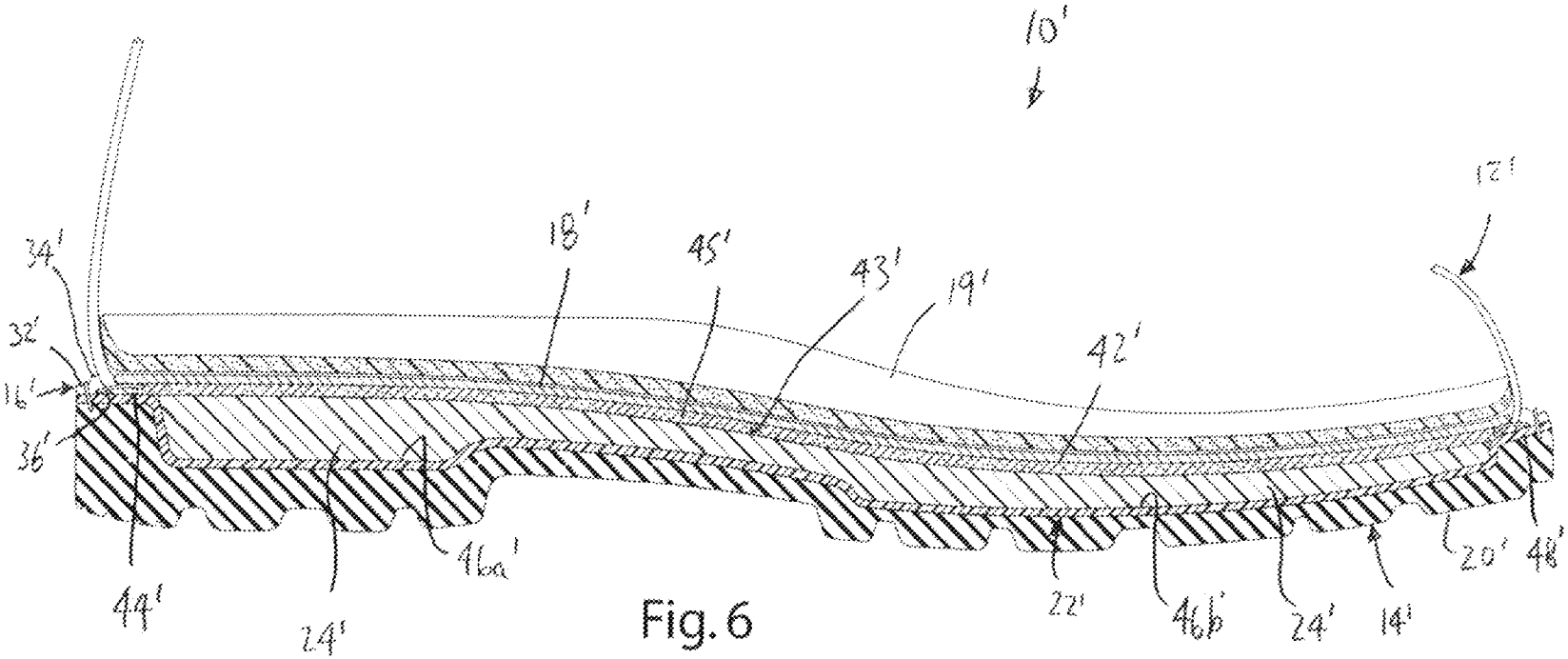
FIG. 6 a cross-sectional view of an alternative article of footwear similar to the view shown in FIG. 3.
Figure 7:
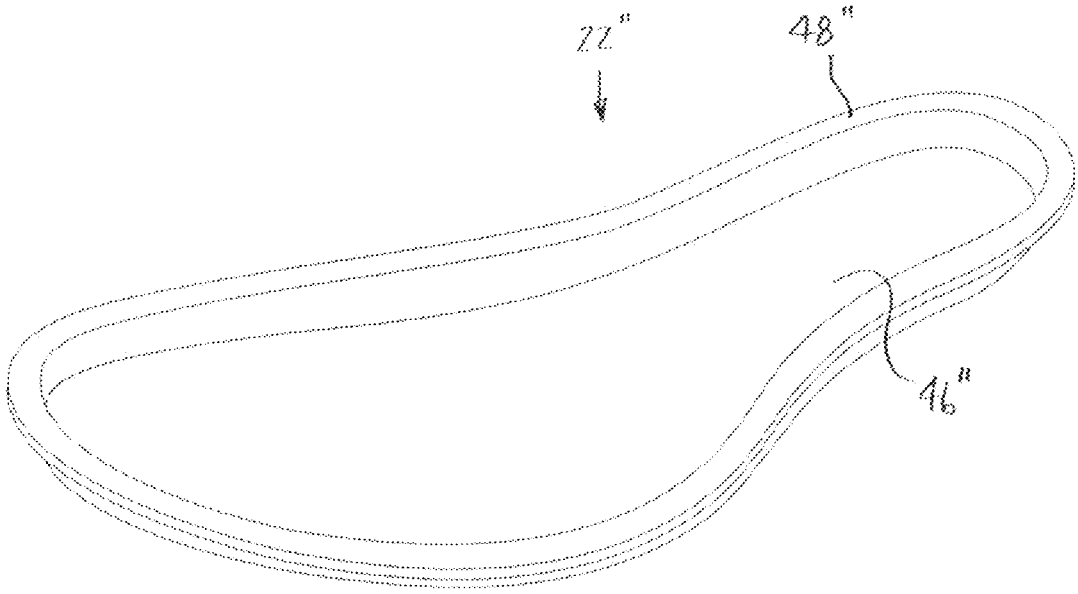
FIG. 7 is a perspective view of an alternative tray.
Figure 8:
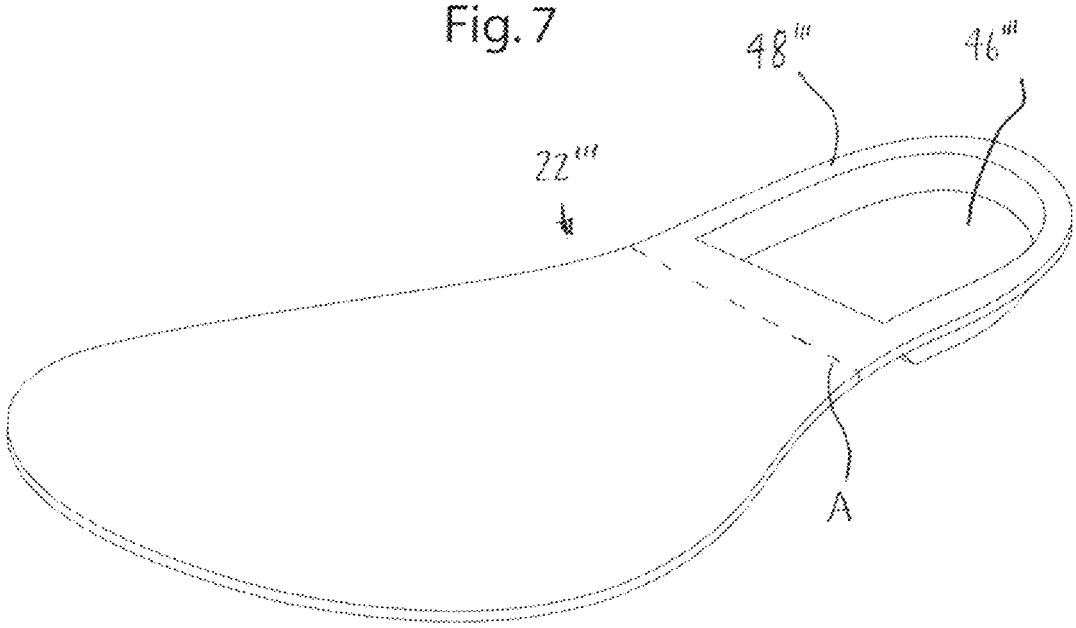
FIG. 8 is a perspective view of a second alternative tray

Although the tray 22 of the illustrated embodiment includes two cavities, the number of cavities may vary. For example, the tray 22 may include only a single cavity. The single cavity may extend through essentially the full length of the sole 14 (See FIGS. 6 and 7) or it may extend through only a portion of the sole 14, such as through just the heel region (See FIG. 8) or just the forefoot region. The alternative embodiment of FIG. 6 includes a full-length cavity in which the cavity becomes shallower in the arch region. FIG. 6 includes reference numerals that are identical to those used in connection with the embodiment of FIG. 3, except that each reference numeral ends with a "". FIG. 7 shows a tray 22" having a full-length cavity 46" in which the depth of the cavity becomes increasingly smaller toward the front of the sole. The tray 22" may include a peripheral lip 48". In this embodiment, the thickness of the outsole may become rather small in the arch region. If desired, the tray 22" may remain exposed to the environment in the arch region. For example, the outsole may be formed in separate heel and forefoot pieces that are spaced apart to leave a gap that exposes the undersurface of the tray 22" in the arch region. FIG. 8 shows an alternative embodiment in which the tray 22''' includes a single cavity 46''' in the heel region. As with tray 22, tray 22''' may include a peripheral lip 48'''. In this alternative embodiment, the tray may run the full length to the sole (as shown in FIG. 8) or it may extend less than the full length, for example, terminating forward of the cavity, such as at broken line A in FIG. 8. As another alternative, the tray may include more than two cavities. For example, the tray may define a plurality of cavities in the forefoot region and/or in the heel region. The size, shape and configuration of the cavities may vary from application to application as desired. For example, the depth of the cavities (individually or collectively) may be varied to balance the amount of low-density cushioning material contained in the tray 22 with the amount of high-density material in the outsole 22. In applications where a thinner sole 14 is desired, it may be beneficial to reduce the depth of the cavities. The illustrated tray 22 is essentially coextensive with the sole 14. Alternatively, the tray 22 may extend through a portion (or through portions) of the sole 14. For example, the tray 22 may extend only through the heel region of the boot 10 (such as illustrated by broken line A in FIG. 8) or only through the forefoot region of the boot 10.

The filling material 24 is a low density cushioning material. In the illustrated embodiment, the filling material 24 is low-density PU. As described below, the filling material 24 may be molded in place within the cavities 46*a-b*. The density and precise chemical make-up of the PU may vary from application to application depending on a variety of factors, including the size of cavities 46*a-b* and the desired cushioning and flexibility characteristics. In some application, the tray cavities may be filled by pre-manufactured materials that are placed in the cavities, such as die cut inserts. In such applications, the pre-manufactured materials may be secured in the cavities, for example, by an adhesive or by a friction fit.

As noted above, the outsole 20 is secured to the tray 22. In the illustrated embodiment, the outsole 20 is a high-density PU that is direct-attached to the undersurface of the tray 22. The outsole 20 may vary from application to application to provide the desirable balance of sole characteristics. For example, the thickness and material from which the outsole 20 is formed may be selected as a function of the desired durability and cushioning properties. Although the undersurface of the illustrated outsole 20 directly engages the ground, the outsole 20 may include a ground-engaging layer that covers some or all of the undersurface of the sole, such as a relatively thin layer of rubber or other similarly durable material that is cemented to the outsole 20.

The boot 10 is manufactured using generally conventional machinery. The insole 14 is manufactured using conventional techniques and apparatus. The insole base 42 and insole rib 44 are manufactured in a conventional manner. The insole rib 44 is attached to the undersurface of the insole base 42 by cement, adhesives or other conventional methods. Alternatively, the insole 14 can be manufactured with an integral base and rib. During manufacture of the boot 10, the pre-manufactured insole 12 is stapled or otherwise secured to the bottom surface of a conventional last (not shown).

The upper 12 is manufactured using generally conventional techniques and apparatus. The desired upper material (not shown) is cut to form the various elements of the upper, including the vamp 28, quarter 29, and heel piece 30. The elements of the upper 12 are then fitted and sewn together using conventional methods and apparatus. A lining (not shown) may be sewn within the upper during the fitting step. The fitted upper 12 is stretched over a last (not shown) and stapled to insole 12. The insole rib 44 is stapled directly to the lower peripheral edge 26 of the upper 40 using conventional apparatus and techniques to intersecure the upper 12 and insole 18. Alternatively, insole rib 44 can be sewn to the upper 12 in a conventional manner.

The welt 16 is manufactured using conventional techniques and apparatus. For example, the welt 16 can be extruded from a hard durable rubber. Once the upper 12 is lasted to the insole 18, the welt 16 is attached to the upper 12 and insole 18. First, lower welt rib 36 is stitched or stapled around the periphery of the upper 12 and insole 18 using conventional apparatus and techniques. This rib stitch 70 extends entirely through the lower welt rib 36, the lower peripheral edge 26 of the upper 12, and the insole rib 18. A filler material 45 is fitted below the insole 18 within the void 43. As noted above, the filler material 45 may be carpet pad or other cushioning materials. If desired, a shank (not shown) or other conventional sole component can be cemented to the bottom surface of the insole 18 using conventional adhesive or cement.

The tray 22 is manufactured using conventional techniques and apparatus. The tray 22 may be injection or pour molded from a hard, durable material, such as TPU, using conventional molding apparatus. The tray 22 can, however, be manufactured from other durable materials, such as rubber. The cavities 46 and peripheral lip 48 are formed during the molding operation as an integral part of the try 20. If desired, the tray 22 may be provided with structure to facilitate a mechanical bond between the tray 22 and the low density cushioning material 24 and/or the tray 22 and the outsole 20. For example, the surface of the tray 22 in the cavities 46*a-b* may be roughed or include protrusions that become mechanically bonded with the low density cushioning material as it is formed in situ within the cavities 46*a-b*. As another example, the undersurface of the tray 22 may be roughed or include protrusions, such as scallops, that provide a mechanical bond between the tray 22 and the outsole 20 when the outsole 20 is direct attached to the tray 22.

The cavities 46*a-b* of the tray 22 are filled using conventional PU molding techniques and apparatus. More specifically, the tray 22 is placed in a mold (not shown) and low-density PU foam is introduced into the cavities 46*a-b* and allowed to cure. Once sufficiently cured, the tray 22 may be removed from the mold. PU is generally well known in the footwear industry, and therefore will not be described in detail. Suffice it to say PU foam is typically derived by combining a polyether, such as polypropylene glycol, with a diisocyanate in the presence of water and a catalyst. The resulting chemical reaction produces carbon dioxide, which causes the polymer to foam. The rigidity and flexibility of the PU can be varied from application to application, as desired, using a variety of well-known techniques, such as by adjusting the type and proportionate amount of the reactants. In addition, the rigidity and flexibility of the PU can be varied by adjusting the volume of PU foam deposited in the tray cavities. Although the illustrated embodiment includes low-density PU, the cavities may contain alternative low density cushioning materials. Further, the low-density cushioning material need not form within the cavities. Rather, the cushioning material may be pre-manufactured and placed in the tray cavities 46*a-b*.

The filled tray 22 is attached to the upper/welt/insole combination using conventional machinery. The tray 22 is stitched to the welt 16 by a line a stitching that extends down through the welt 16 at stitch groove 38 and the peripheral lip 48 of the tray 22. In the illustrated embodiment, the line of stitching extends entirely around the periphery of the sole 14. The stitches 70 are recessed in groove 38 so that they are protected from abrasion and wear. If desired, the tray 22 may also be cemented or otherwise adhesively secured to the undersurface of the insole filler material 45 and/or the undersurface of the base of the welt 16.

Figure 9:
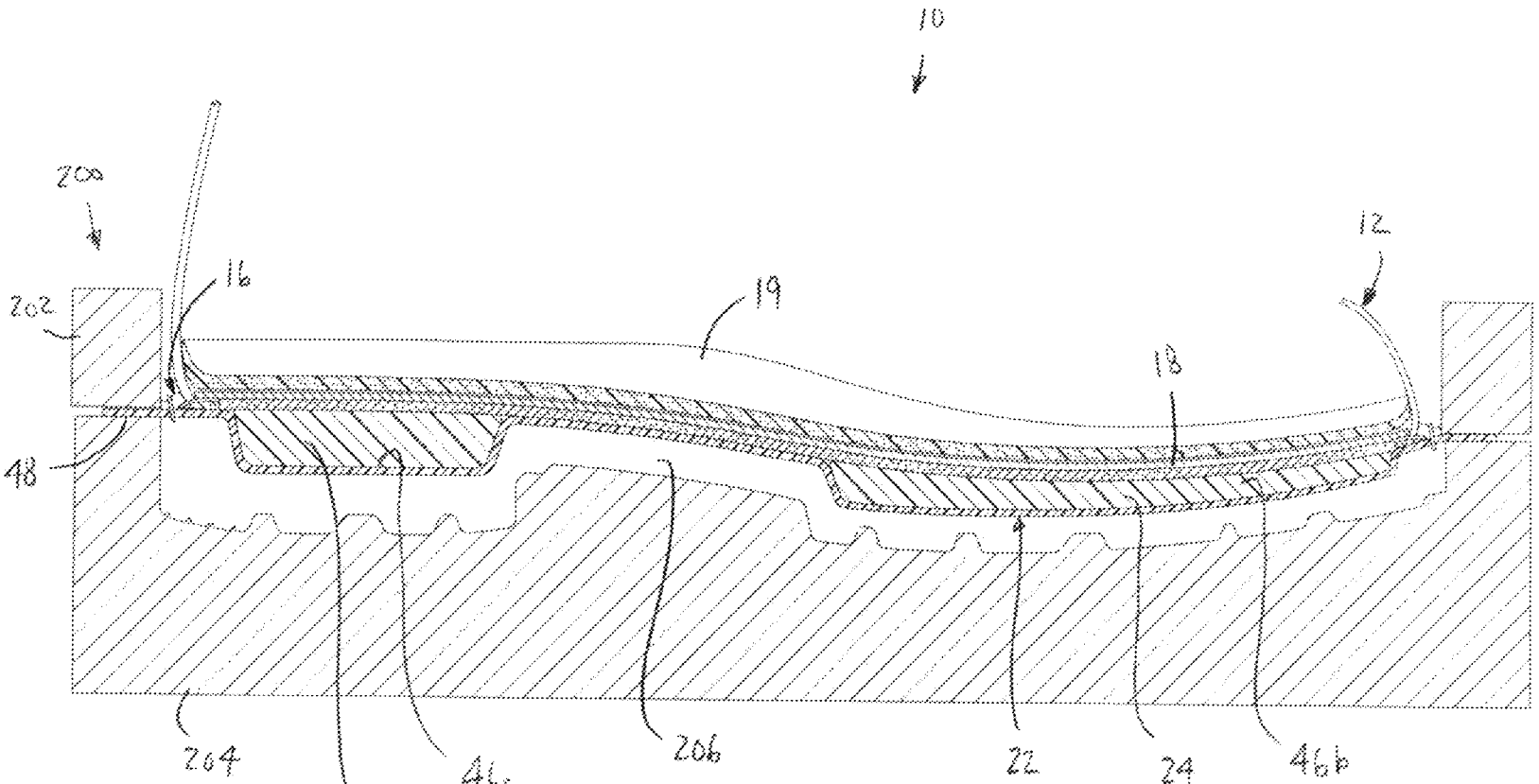
FIG. 9 is a sectional view of an outsole mold showing the molding of the outsole to the undersurface of the tray.

In the illustrated embodiment, the outsole 22 is direct-attached to the undersurface of the tray 22. This may be achieved using a conventional pour-mold die 200 that facilitates assembly of the boot 10. The die includes a top half 202, which receives the upper/welt/insole/tray combination, and a bottom half 204, which includes a cavity 206 that defines at least a portion of the shape of the outsole 20. The die halves 202, 204 are designed such that they can be closed to hold the upper/welt/insole/tray combination in appropriate alignment with the outsole 20. As shown in FIG. 9, the outer portion of the peripheral lip of the tray 22 is compressed between the top half 202 and the bottom half 204 of the pour-mold die 200. This creates a seal to contain the PU in the outsole cavity.

After the outsole 20 and the upper/welt/insole/tray combination are inserted into the die halves 202, 204, the appropriate volume of outsole material 24, which in the illustrated embodiment is a high-density PU, is poured into the mold cavity 206. As the PU is poured into the mold cavity 206, it begins to expand and cure. The die 200 is immediately closed. The PU continues to expand and cure, causing it to fill the mold cavity 206 to form the outsole 20. In this way, the outsole 20 becomes intimately bonded to the undersurface of the tray 22.

Finally, a number of conventional finishing operations may be performed on the boot 10. For example, the edge of the sole 14 (including the lip 48 of the tray 22) may be trimmed and shaped; the upper 12 may be cleaned, polished and treated as appropriate and necessary; and the laces may be inserted in the eyelets.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. An article of footwear comprising:
an upper;
a sole joined to said upper by a welt, said sole including:
an insole;
a tray disposed beneath said insole, said tray defining at least one cavity, a low density cushioning material disposed in said cavity; and
an outsole secured to said tray;
said welt secured to said upper, said insole and said tray.

2. The article of footwear of claim 1 wherein said tray includes a heel cavity and a forefoot cavity, each of said heel cavity and said forefoot cavity containing a low density cushioning material.

3. The article of footwear of claim 2 wherein said tray includes a peripheral lip, said welt secured to said peripheral lip.

4. The article of footwear of claim 3 wherein said peripheral lip is coextensive with an undersurface of said welt.

5. The article of footwear of claim 1 wherein said low-density cushioning material is low-density polyurethane molded in situ within said cavity.

6. The article of footwear of claim 5 wherein said outsole is high-density polyurethane direct-attached to an undersurface of said tray.

7. The article of footwear of claim 6 wherein said welt is secured to said upper and said insole by a first line of stitching and to said tray by a second line of stitching.

8. An article of footwear comprising:
an upper having a lower peripheral edge;
an insole disposed adjacent said lower peripheral edge of said upper;
a tray disposed beneath said insole, said tray defining at least one cavity, said cavity containing a low-density cushion material;
a welt joining said upper, said insole and said tray;
a first line of stitching extending through said welt, said lower peripheral edge of said upper and said insole;
a second line of stitching extending through said welt and said tray; and
an outsole secured to said tray.

9. The article of claim 8 wherein said tray includes a peripheral lip, said second line of stitching extending through said welt and said peripheral lip of said tray.

10. The article of claim 8 wherein said tray includes at least two cavities, each of aid cavities containing a low density cushioning material.

11. The article of claim 8 wherein said tray includes a heel cavity and a forefoot cavity, each of said heel cavity and said forefoot cavity containing a low density cushioning material.

12. The article of claim 11 wherein said tray is manufactured from a thermoplastic urethane.

13. The article of claim 12 wherein said insole defines a void containing a filler material, said tray being adhesively secured to said filler material.

14. The article of claim 13 wherein said outsole is direct-attached to said tray and is manufactured from high-density polyurethane.

15. A method for constructing an article of footwear, comprising the steps of:
mounting an insole to a last;
fitting an upper to the last;
securing a welt to the insole and the upper to form an upper/welt/insole combination;
providing a tray defining a cavity;
introducing a low density cushioning material into the cavity;
securing the tray to the welt;
securing an outsole to the tray.

16. The method of claim 15 wherein said introducing step includes the steps of:
placing the tray in a mold cavity in a mold;
introducing low-density polyurethane into the cavity;
closing the mold after said step of introducing low-density polyurethane into the cavity;
allowing the low density polyurethane to cure, thereby directly bonding to the tray; and
removing the tray from the mold.

17. The method of claim 15 wherein the tray includes separate heel and forefoot cavities, said introducing step being further defined as introducing a low density cushioning material into the heel cavity and the forefoot cavity.

18. The method of claim 17 wherein said outsole securing step is further defined as direct-attaching the outsole to the tray.

19. The method of claim 15 wherein said outsole securing step includes the steps of:
placing the upper/insole/tray combination in an outsole mold defining a mold cavity, the tray being exposed to the mold cavity and cooperating with the mold cavity to define a void in a desired shape of the outsole;
introducing high-density polyurethane into the void in a desired shape of the outsole;
allowing the high-density polyurethane to cure, thereby directly bonding to the outsole to the tray.

20. The method of claim 15 wherein said step of securing the welt to the insole and the upper includes stitching the welt to the insole and the upper; and
said step of securing the welt to the tray includes stitching the welt to the tray.

* * * * *